United States Patent [19]

Aiello

[11] Patent Number: 4,955,927

[45] Date of Patent: Sep. 11, 1990

[54] METHOD OF OPERATING HARNESS MAKING MACHINE

[75] Inventor: Bruno Aiello, Alta, Italy

[73] Assignee: AMP Incorporated, Harrisburg, Pa.

[21] Appl. No.: 283,698

[22] Filed: Dec. 13, 1988

[30] Foreign Application Priority Data

Mar. 10, 1988 [GB] United Kingdom ..... 8805474

[51] Int. Cl.[5] ..... H01R 43/04

[52] U.S. Cl. ..... 29/861; 29/56.6; 29/747; 29/749

[58] Field of Search ..... 29/747, 861, 56.6, 749, 29/753, 863, 857; 140/92.1

[56] References Cited

U.S. PATENT DOCUMENTS

| | | | |
|---|---|---|---|
| 4,126,935 | 11/1978 | Rhines et al. | 29/749 X |
| 4,380,117 | 4/1983 | Brandewie et al. | 29/747 X |
| 4,400,874 | 8/1983 | Craver et al. | 29/861 |
| 4,428,114 | 1/1984 | Teagno . | |
| 4,441,251 | 4/1984 | Grubb . | |
| 4,492,023 | 1/1985 | Schneider et al. | 29/861 |
| 4,493,147 | 1/1985 | Bakermans | 29/861 |
| 4,525,927 | 7/1985 | Guerout et al. | 29/861 |
| 4,653,825 | 3/1987 | Olsson | 29/861 X |

FOREIGN PATENT DOCUMENTS

| | | |
|---|---|---|
| 0099684 | 7/1982 | European Pat. Off. . |
| 0139365 | 5/1985 | European Pat. Off. . |
| 1528972 | 10/1978 | United Kingdom . |

*Primary Examiner*—Carl E. Hall
*Assistant Examiner*—Carl J. Arbes
*Attorney, Agent, or Firm*—William B. Noll

[57] ABSTRACT

This invention is directed to a method for operating an electrical harness making machine on which a variety of electrical connectors may be used with a common set of tooling. In such an operation, a leading end of a wire is terminated in a preselected terminal of a row of terminals in a first electrical connector at a first operating station, and the trailing end of said wire is terminated in a preselected terminal of a row of terminals in a second electrical connector. The electrical connectors traverse a number of operating stations at which additional discrete wire segments are terminated to such electrical connectors to produce an electrical harness. The unique feature hereof in the operation of the harness making machine in the provision of selecting said electrical connectors from a family of connectors characterized by having a plurality of identical external features, and a plurality of different internal features to accommodate a different contact element for each member of said family, and by the step of operating said machine by sensing only said identical features of the electrical connectors as they traverse said path to produce an electrical harness.

5 Claims, 10 Drawing Sheets

FIG. 2
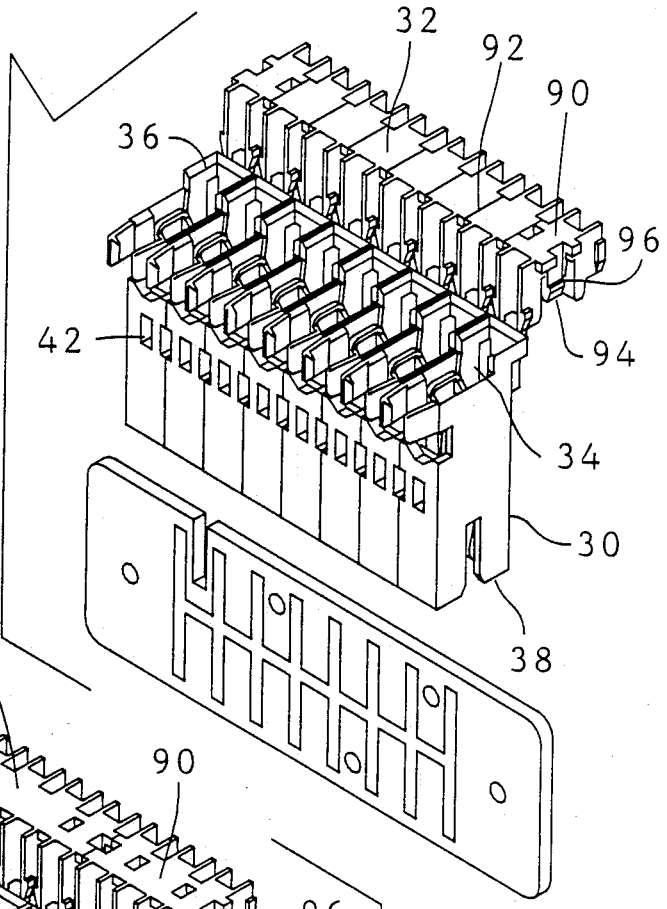
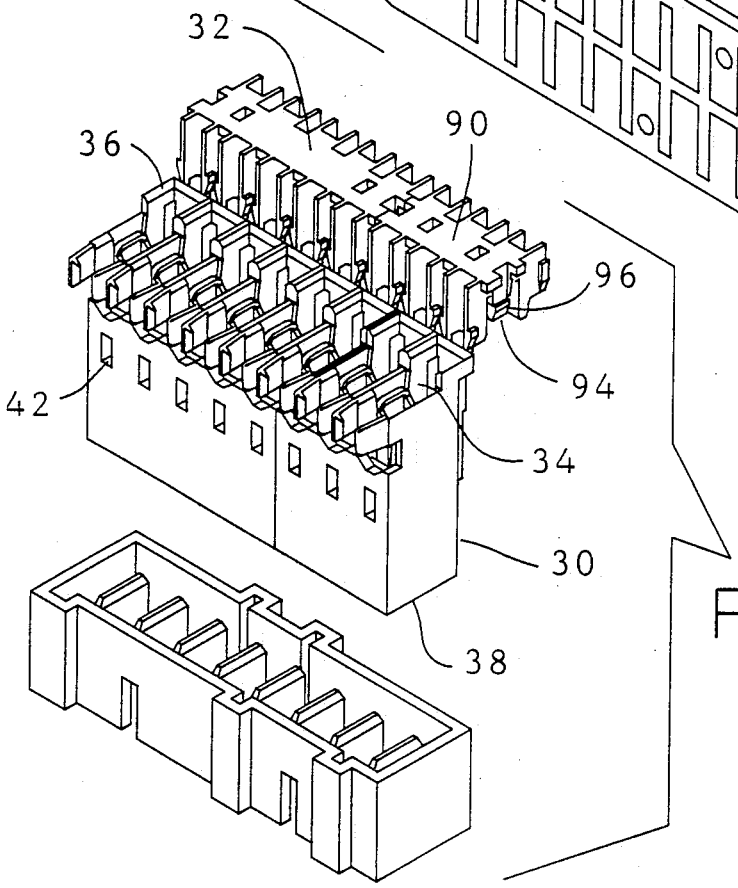
FIG. 3

METHOD OF OPERATING HARNESS MAKING MACHINE

BACKGROUND OF THE INVENTION

This invention is directed to a method of operating a multi-harness making machine in which a pair of electrical connectors are terminated by the respective ends of a series of discrete wire segments. Specifically, in the operation of such a machine, a leading end of a wire is terminated in a preselected terminal of a row of terminals in a first electrical connector at a first operating station, and the trailing end of said wire is terminated in a preselected terminal of a row of terminals in a second electrical connector. The electrical connectors traverse a number of operating stations at which additional discrete wire segments are terminated to such electrical connectors to produce an electrical harness.

An exemplary type of electrical connector contemplated by this invention is one in which a wire conductor can be terminated by forcible insertion transversely of its axis along a conductor receiving slot of a contact member. Such contact member is mounted in a cavity in an insulating housing body adjacent one end and retained in the slot by engagement with a cover member movable into latching engagement with the housing body to engage the conductor thereby to retain the conductor in the slot. For a more detailed discussion of such a connector, reference is made to published EP application Ser. No. 0317099, the disclosure of which is incorporated by reference in this specification.

The connectors, referenced above, have become increasingly widely used, particularly in the automotive and domestic appliance industries as they are well adapted for assembly by automated, mass production, techniques and yet ensure a very reliable, insulated, electrical connection to the conductor for use in adverse environments subject to vibration.

Electrical harnesses using such connectors may include as many as twenty one discrete wires, by way of example. For a detailed discussion on apparatus for manufacturing a harness assembly, reference is made to U.S. Pat. No. 4,428,114. A major shortcoming of such apparatus is that typically it is operated using a single type of electrical connector. If one desires to change connectors, tooling changes are required.

SUMMARY OF THE INVENTION

The present invention, by the method taught herein, expands the versatility of a harness making machine by permitting the use of a family of different connectors, in which each member of such family is characterized by a plurality of identical external features, and that only such identical features are sensed by the machine as the connectors move through a, progression of operating zones. Such versatility will become apparent from the specification which follows.

BRIEF DESCRIPTION OF THE DRAWINGS

FIGS. 2 to 5 are perspective views of various connector housing combinations, illustrating common external features, which housing combinations may be suitably processed by the method hereof.

DETAILED DESCRIPTION OF PREFERRED EMBODIMENT

Figure 1:
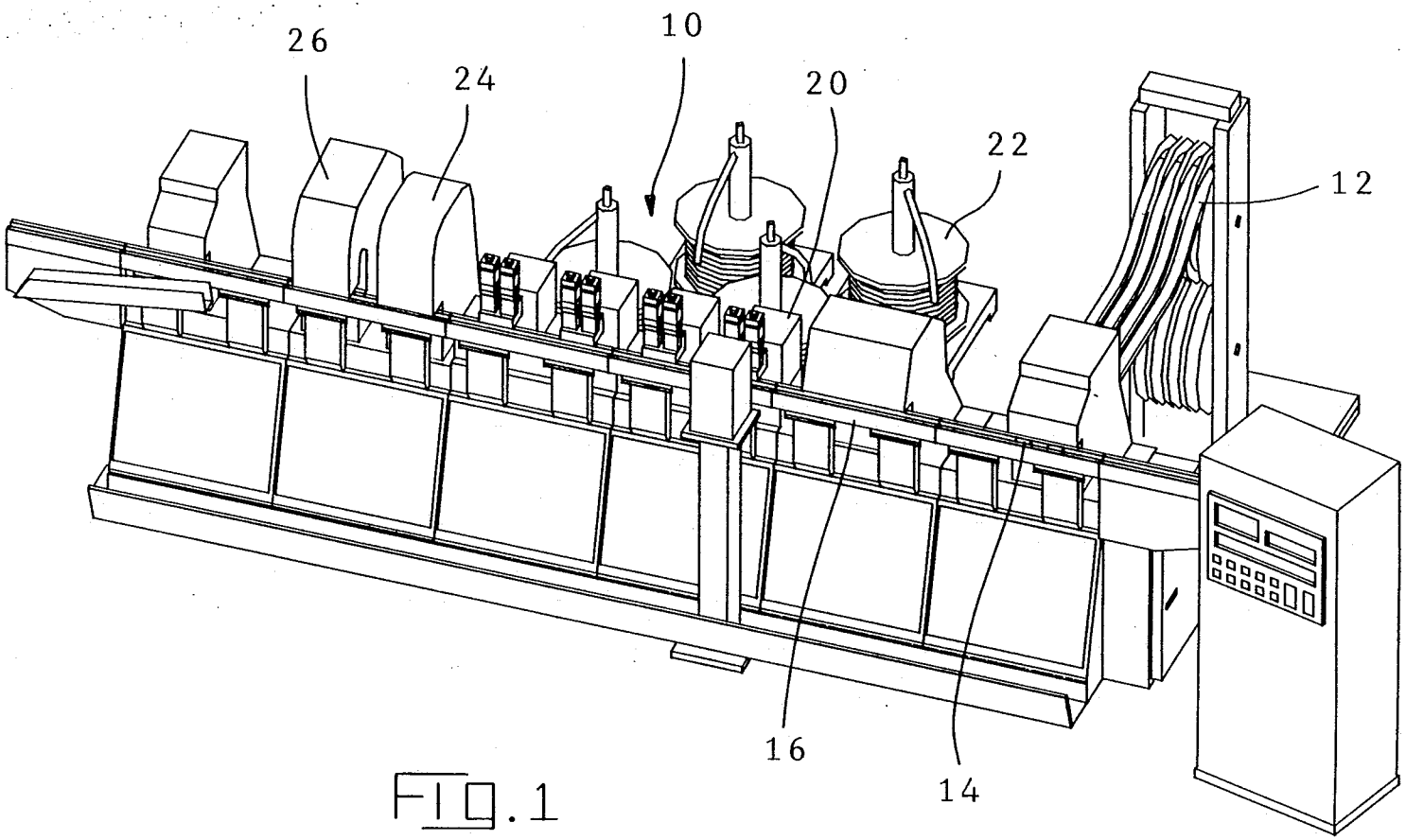
FIG. 1 is a perspective view of a harness making machine, featuring various stages of the operation, for practicing the method of this invention.
Figure 1A:
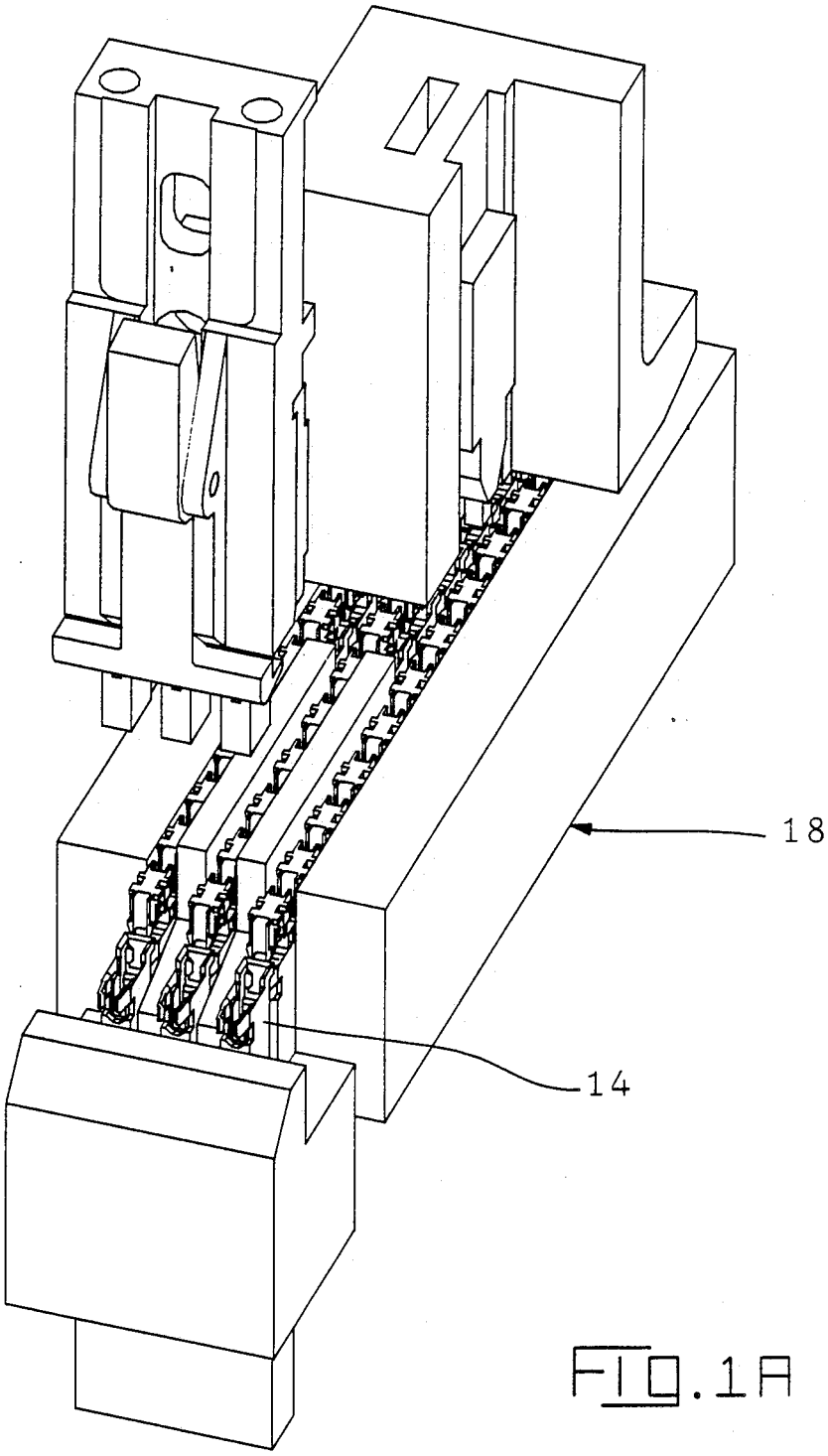
FIG. 1A is an enlarged perspective view of a connectors feeding station for the harness making machine of FIG. 1.
Figure 1B:
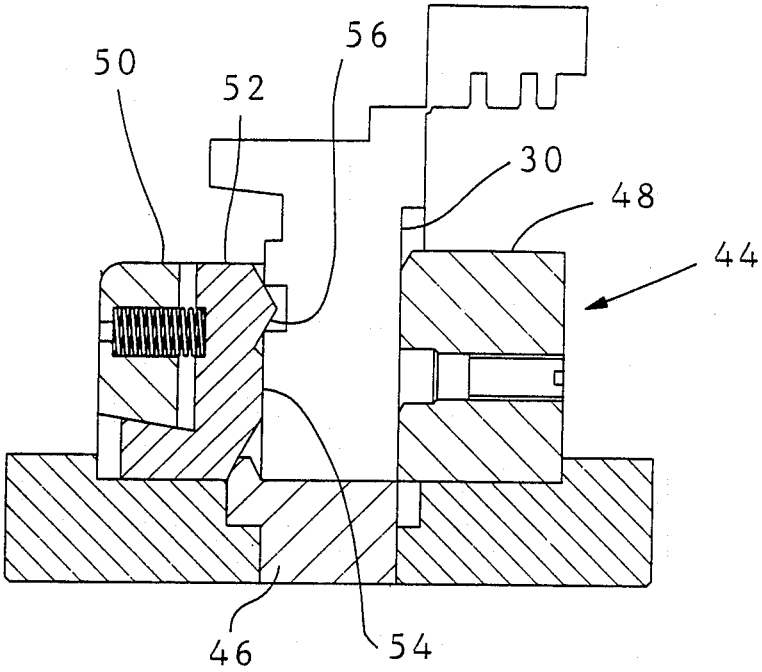
FIG. 1B is an enlarged sectional side view of a connector holder for securing a connector during wire termination for the apparatus of FIG. 1.
Figure 1C:
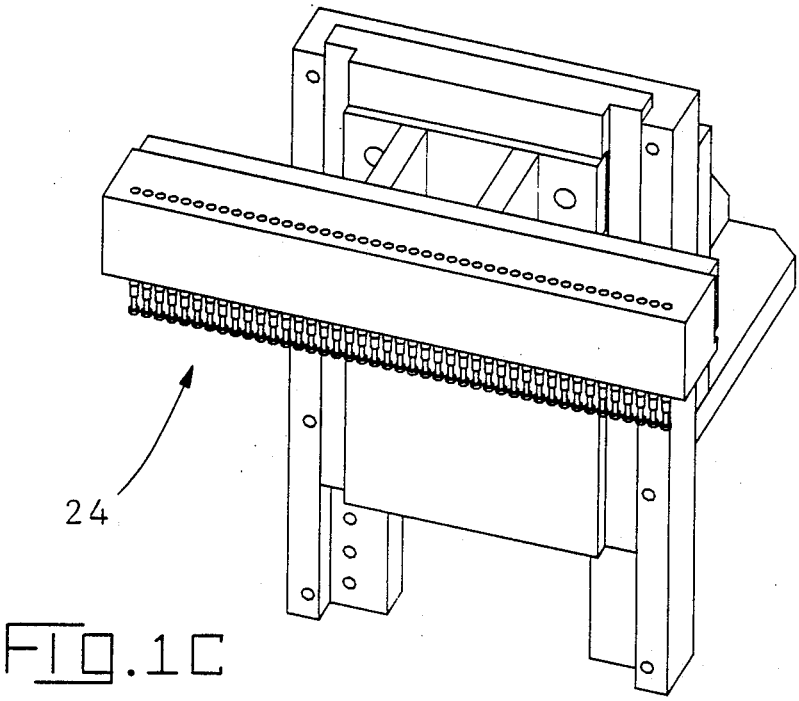
FIG. 1C an enlarged perspective view of a harness electrical testing unit, which is downstream of the wire terminating station, for the apparatus of FIG. 1.
Figure 1D:
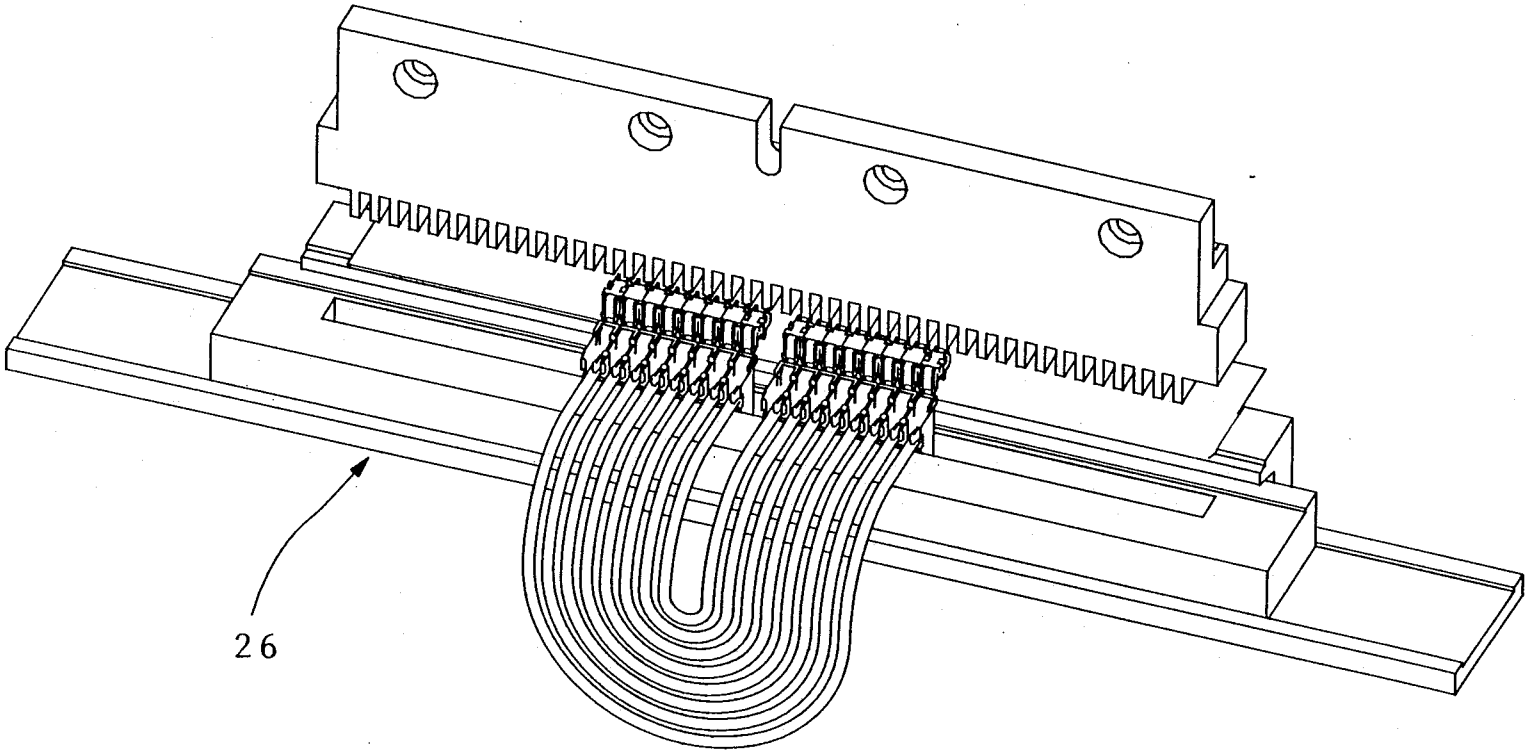
FIG. 1D is an enlarged perspective view of a connector cover loading station for the apparatus of FIG. 1.
Figure 1E:
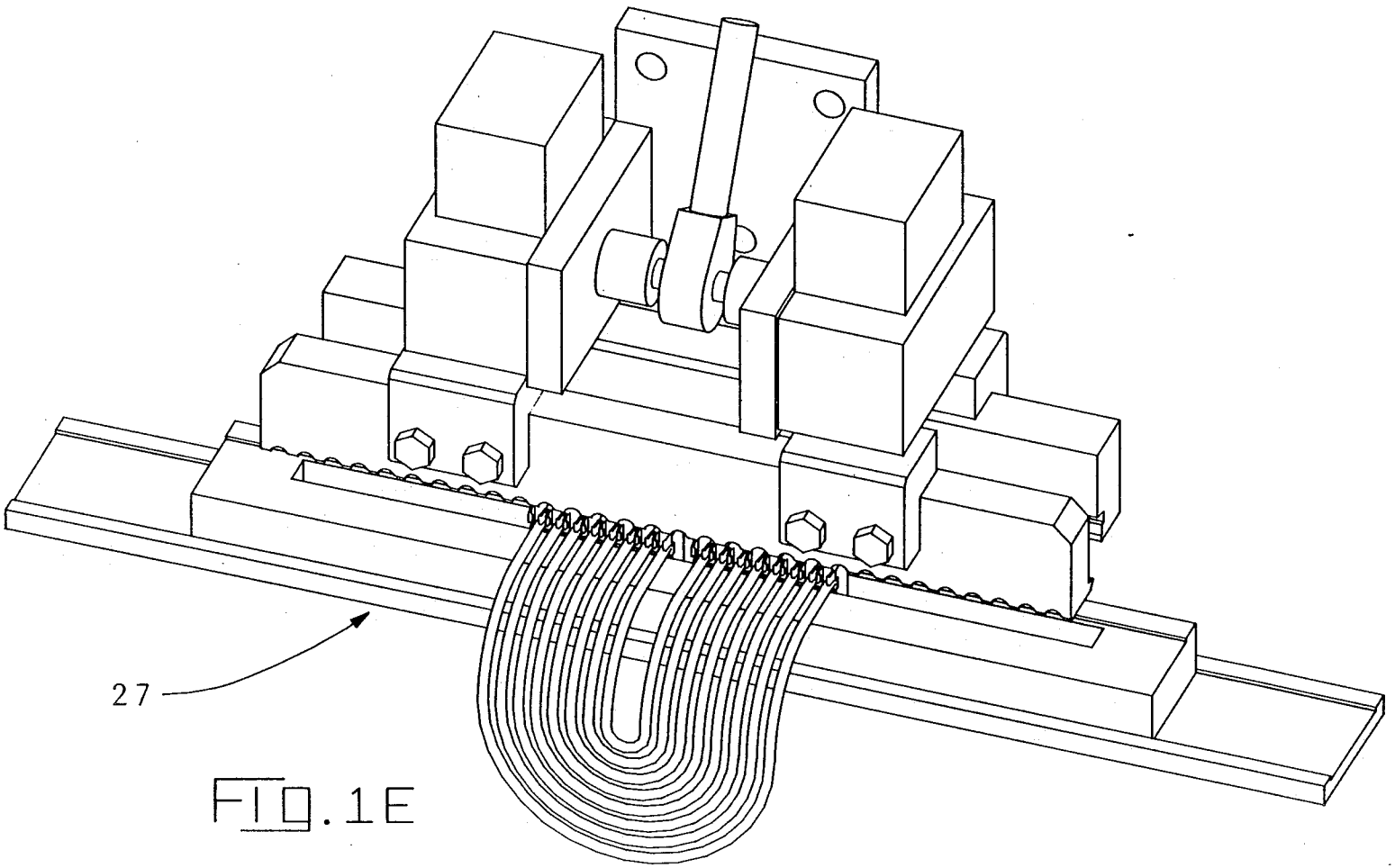
FIG. 1E is an enlarged perspective view of a harness unloading station for the apparatus of FIG. 1.
Figure 1F:
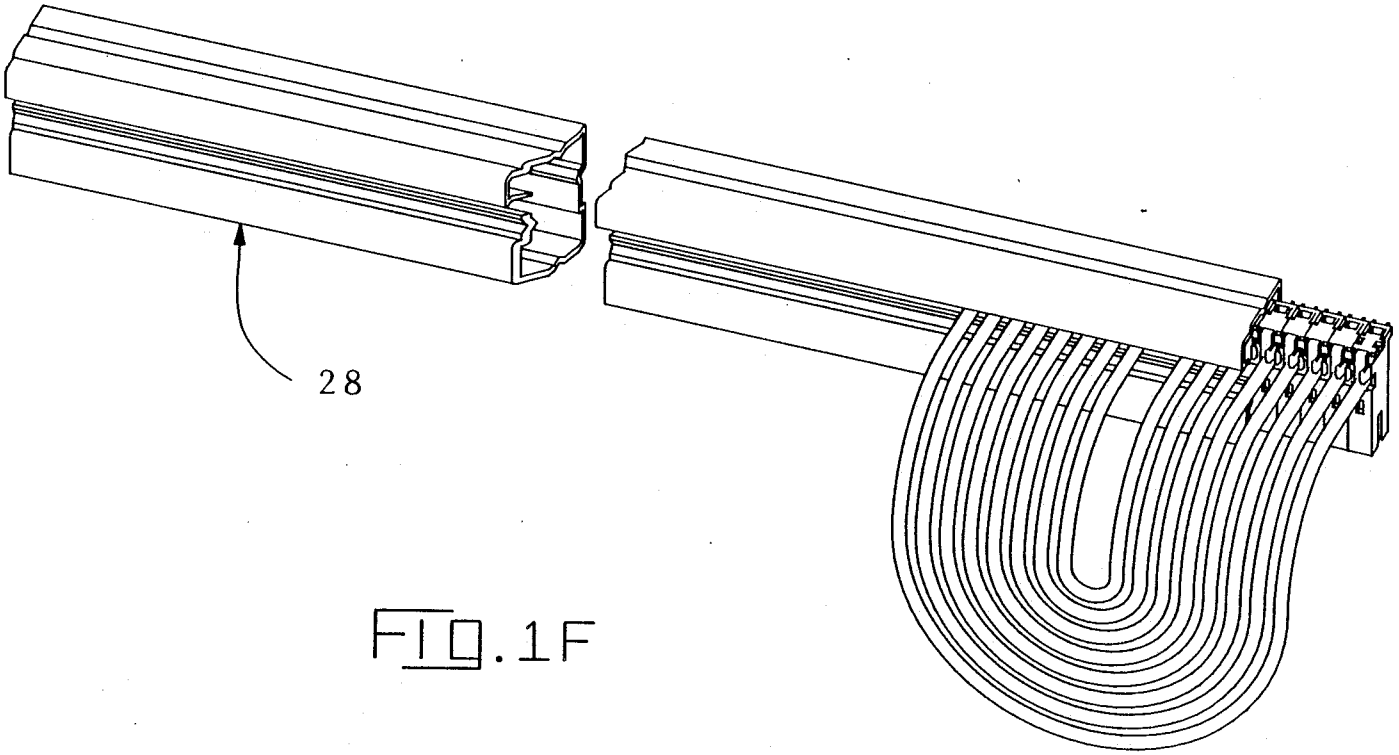
FIG. 1F is an enlarged perspective view of a harness conveying or storage station for the apparatus of FIG. 1.

Turning to FIG. 1 there is illustrated representative apparatus lo upon which the method of this invention may be practiced. At the right side thereof, or connector entry side, a plurality of feeder channels 12 are provided to feed the desired electrical connectors 14 to a transverse feed path 16. Such connectors are sensed for progressive movement along the feed path 16 through the various operating stations. For example, a pair of connectors 14, securely held by connector holder such as shown in FIG. 1B, move from the feeding station 18 into a first wire termination station 20. Here, a leading wire of a wire extending from a wire supply reel 22 is terminated in a preselected terminal of a row of terminals in a first connector. Further wire is fed from said supply reel 22 to form a trailing loop and the trailing end of the wire is terminated in a preselected terminal of a row of terminals in a second connector. The wire is severed from the supply reel 22 so that a new wire may be terminated to a respective terminal of each connector. The connectors pass along path 16 through several terminating stations to connect the remaining wires of the harness assembly.

After such wire terminations, the harness assembly is electrically tested 24 for open circuits and continuity. If a positive result is received at the testing station 24, the assembly moves on to a cover loading station 26, then to the unloading station 27 and storage 28 for shipment.

In accordance with the method of this invention, it is possible to manufacture harness assemblies using different connectors, or to produce a mix of harness assemblies without having to change the tooling therefor. This is achieved by sensing only common external features and/or dimensions of the connector housings within the connector holder, as hereinafter described, as they traverse feed path 16.

Considering several exemplary connectors in more detail, as illustrated in FIGS. 2–5, the connectors comprise a housing body 30 and cover member 32, typically molded in one piece of a plastic insulated-type material. The housing body 30 is formed with one or a row of elongate cavities 34 opening to opposite cover member receiving and mating ends 36 and 38, respectively, of the housing body and each receiving a contact member of generally known form.

As shown by such Figures, the external geometry for each connector housing is essentially identical to the others. That is, the cover member receiving end 36, the depth and width are all the same. Even in the case of the single connectors (FIG. 5), spacing webs 40 are provided between adjacent connectors such that the depth, width, and height of the assembled group of connectors is the same as those illustrated in FIG. 2–4. Another common feature is the window 42, the function of which is defined later.

Figure 4:
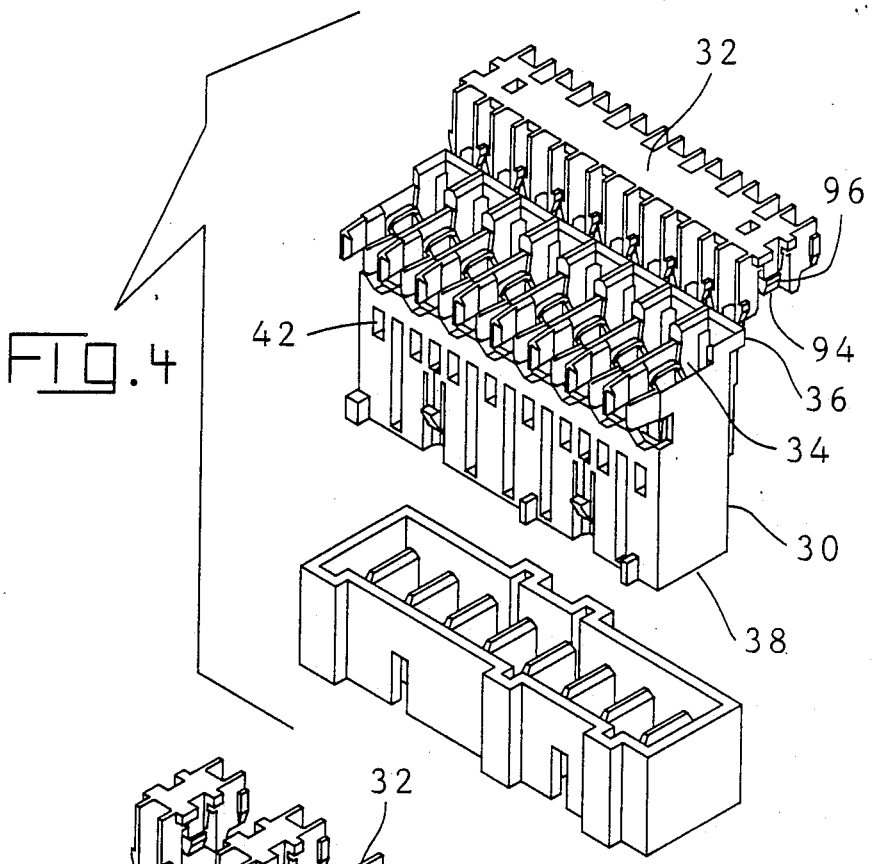

Within the framework of this invention, there are countless combinations available to the harness manufacturer and its customer. For example, FIG. 2 illustrates an 8 way connector formed by eight single housing units, side-by-side. FIG. 3 shows a similar 8 way connector, formed by joining a 3 way and 5 way connectors. FIG. 4 is a typical one piece 8 way connector. But again, each form of the illustrated connectors share certain common external features which allows for the versatility and flexibility of this invention.

Turning again to the connector holder of FIG. 1B, an exemplary illustration of a connector holder 44 is presented for practicing this invention. Such holder 44, shown in section with a connector housing fixed therein, comprises a base 46 which traverses feed path 16, a rear upright member 48, against which said connector rests, and an adjustable front member 50. Such front member 50 includes a spring biased clamping portion 52, the housing face 54 of which is provided with a projection 56 for seating in a window 42 of the housing. Such projection fixes the housing against relative movement within the holder during the wire termination operations. As illustrated in the housing embodiments of FIGS. 2 to 5, such window 42 is another common external feature of such connector housings.

Figure 6:
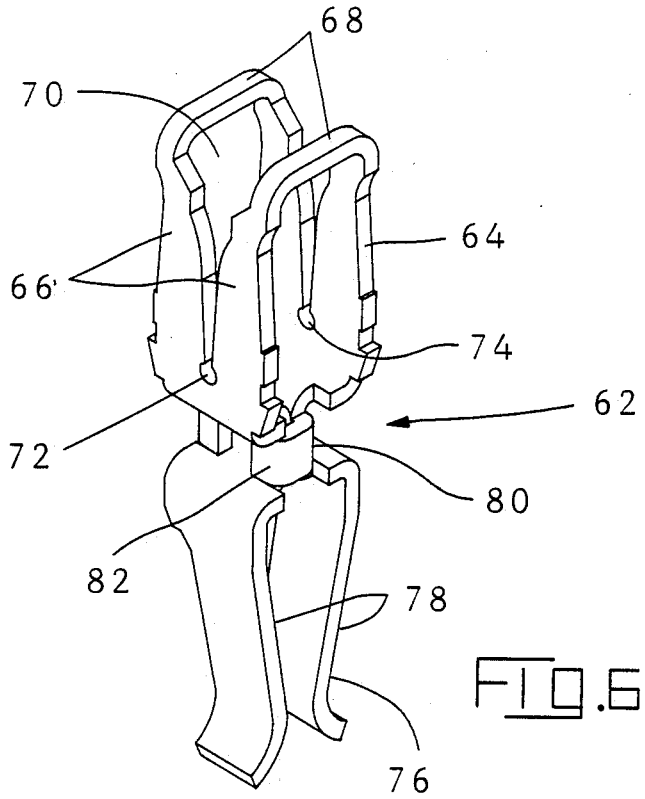
FIG. 6 is an enlarged perspective view of one embodiment of a contact member for use in the housing combinations of FIGS. 2 to 5.
Figure 7:
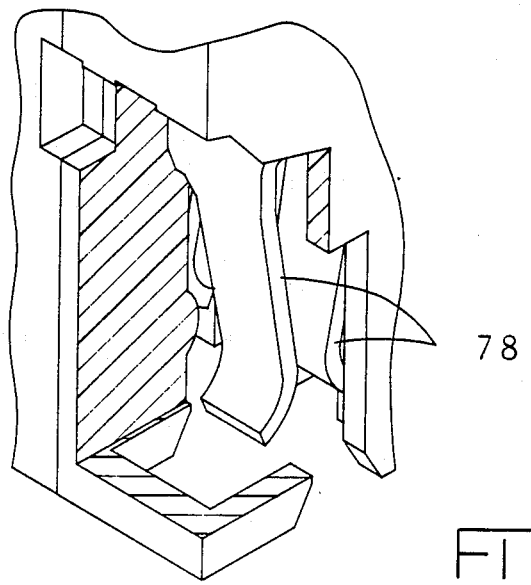
FIGS. 7 to 9 are partial enlarged perspective views of various contact receiving portions of a contact member for use in the practice of this invention.

Considering the contact members, to be inserted into the housing cavities 34, reference is made to the embodiment shown in FIG. 6. Typically, each contact member 62 may be stamped and formed in one piece from sheet metal strip and comprises a conductor connecting end 64 constituted by a pair of interconnected, upstanding parallel plates 66 joined by a pair of transverse straps 68 to define a wire receiving mouth 70 converging to a pair of aligned wire receiving slots 72 and 74 in respective plates.

For this invention, such conductor connecting end 64 is essentially identical for all contact members so that tooling changes are not required, resulting in down time, at the conductor or wire terminating station.

The tab or board receiving end of each potential contact member can vary depending on its application or use. FIG. 6 illustrates the type of receiving end used to receive a P.C. board, see FIG. 2. Such board receiving end 76 is constituted by a pair of limbs 78 extending in opposed relation from an intermediate, waisted, portion 80 at which ears 82 extending from one strip portion are clinched around an opposite strip portion to secure the plates 66 and limbs 78 together.

To retain such contact members within the housing cavities, shoulders may be provided therein. More specifically, as is known, when a contact member 62 is inserted into a cavity 34, the straps 68 engage shoulders formed on opposed end walls on the cavities thereby preventing further movement into the cavity and providing support for the contact during wire insertion.

Figure 8:
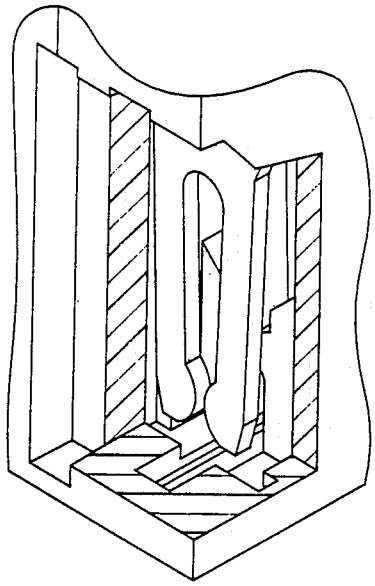
Figure 9:
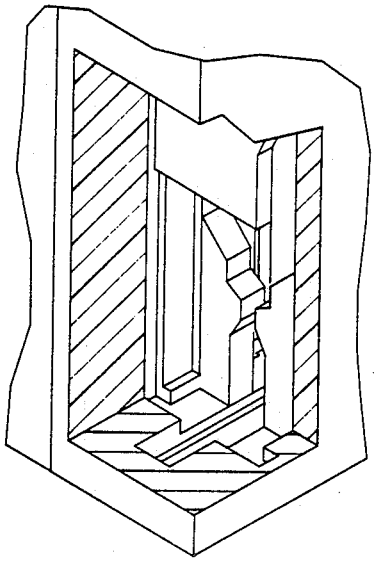

FIGS. 8 and 9 illustrate two different configurations for a tab receiving end of a contact member. Representative tabs are shown below the housings of FIGS. 3 to 5, i.e. a series of aligned tabs in a housing, or a single tab.

Figure 5:
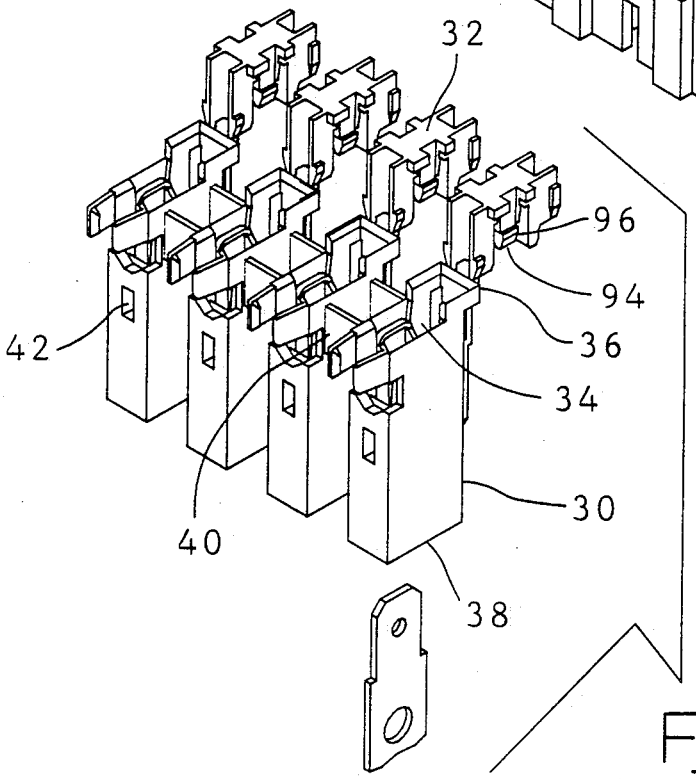

For a detailed discussion on the mating and latching relationship of the housing body 30 and cover member 32, reference is again made to British Pat. Specification Ser. No. 8726808. Notwithstanding such detailed disclosure, it may be briefly stated that the cover member serves multiple functions, such as wire stuffing and internally and externally latching the cover to the housing body. This will become evident by the following. The cover member 32 comprises one or a row of segments 90 interconnected by webs 92. Each segment 90 is shaped for receipt in the cavity 34 in the cover member receiving end 36, with the webs 92 then overlying the end walls between adjacent cavities. Typically, the cover contains a plurality of segments 90, a number which is consistent with the number of cavities 36 in the housing. However, as illustrated in FIG. 5, this invention contemplates a single cavity version. Nevertheless, in accordance with the multi-cavity version such as shown in FIGS. 2, 3 and 4, at least the end-most segments 90, that is, one at either end of the cover member 32, are each characterized by a pair of central projections 94 adapted to be received between straps 68 of a corresponding contact member. The ends of projections 94 are provided with latching tabs 96, the purposes of which are to engage beneath straps 68 when the cover member 32 is brought into engagement with the housing body 30.

As for the internal segments 90 of the cover 32, each such segment may include a central land or projection shaped to be received between the plates 66 and straps 68 of a contact member when the cover member 32 is applied to the housing body 30, thereby to serve as a stuffer member for a conductor to be connected to the contact member.

One further and final benefit of this invention is the freedom and flexibility offered to the customer to which the harness assemblies are provided. Often, in the assembly of the electrical circuitry for automotive and appliance applications, robotic means are used. A distinct advantage is the ability to use a single robotic means which, like the tooling sensors hereof, sense only the common external features of the connector housings during the handling thereof. That is, the connectors hereof are suitable for handling by completely automatic robotic means, avoiding any manual operation from the creation of the harness, as taught herein, up to the installation of the harness in the device, such as an automobile, appliance, etc., by such customer.

I claim:

1. A method of operating an electrical harness making machine on which a variety of electrical connectors may be used with a common set of tooling, said machine operable to terminate a plurality of discrete wires to a pair of electrical connectors by causing said connectors to traverse a path extending through a plurality of operating zones, where said variety of electrical connectors comprises a family having a plurality of identical external dimensions normal to said path, and a plurality of different internal features to accommodate a different contact element for each member of said family, whereby said machine is operated by sensing only said identical dimensions of the electrical connectors as they traverse said path to produce an electrical harness consisting of a plurality of discrete wires terminated at respective opposite ends to a pair of electrical connectors, whereby the operating parameters for said machine are the same for each member of said family.

2. The method according to claim 1 wherein said electrical connectors comprise a housing for receiving a contact element and a cover, and that said external features include the cross sectional geometry of said housing, the geometry of said cover, and the means for terminating said discrete wires within said housing.

3. The method according to claim 2 wherein said internal features include said contact element and the design and configuration of the housing cavity for receiving said contact element.

4. The method according to claim 2 wherein said housing may comprise one or more modular units such that the combination of such units has a predetermined cross sectional geometry.

5. The method according to claim 2 wherein a common external feature for each housing is an indent receiving window therein for sensing the location of said housing.

* * * * *